United States Patent [19]

Kim

[11] Patent Number: 4,970,875

[45] Date of Patent: Nov. 20, 1990

[54] PLASTIC PAN ASSEMBLY FOR USE IN AIR CONDITIONERS AND REFRIGERATORS

[75] Inventor: Il Y. Kim, Alexandria, Va.

[73] Assignee: Permanent Solution Industries, Inc., Falls Church, Va.

[21] Appl. No.: 431,903

[22] Filed: Nov. 6, 1989

[51] Int. Cl.[5] ..... F25D 21/00

[52] U.S. Cl. ..... 62/272; 62/285

[58] Field of Search ..... 62/285, 286, 288, 289, 62/272, 291

[56] References Cited

U.S. PATENT DOCUMENTS

| | | | |
|---|---|---|---|
| 1,950,344 | 3/1934 | Williams | 62/285 X |
| 1,975,066 | 9/1934 | Sanderson | 62/285 X |
| 4,597,269 | 7/1986 | Kim | 62/286 |
| 4,823,558 | 4/1989 | Kim | 62/272 |
| 4,862,704 | 9/1989 | Kim | 62/272 |
| 4,916,919 | 4/1990 | Kim | 62/285 X |

*Primary Examiner*—Lloyd L. King

*Attorney, Agent, or Firm*—Birch, Stewart, Kolasch & Birch

[57] ABSTRACT

Plastic primary pan assembly for use in air conditioning systems which includes a base primary pan containing a pair of blind plates having a pair of semi-cylinders, respectively, to be removed one of them from the base primary pan, a pair of rubber packings, and an assembly plate having a pair of semi-cylinders to be inserted into the base primary pan, after taking out one of the pair of blind plates from the base primary pan, assembling with a base primary pan instead of the blind plate so as to pass a pair of built drain pipe therethrough, whereby the plastic primary pan can easily assemble the base primary pan with the assembly plate, the pair of rubber packings, and the pair of drain pipes.

10 Claims, 2 Drawing Sheets

PLASTIC PAN ASSEMBLY FOR USE IN AIR CONDITIONERS AND REFRIGERATORS

BACKGROUND OF THE INVENTION

1. Field of the Invention

The present invention relates to a primary plastic pan assembly for use in conjunction with air conditioning installations and refrigeration systems and more particularly, to a plastic primary pan assembled with a pair of supporting brackets which are mounted to a motor and a fan cover wherein the plastic primary pan includes a pair of cylinders to be disposed at one side of the opposite sides thereof during installation so as to pass a pair of drain pipes through the pair of cylinders.

2. Description of the Prior Art

Primary pans are generally known to be utilized with air conditioning systems. Conventional devices utilize a primary pan made of steel which is directly mounted to a fan cover and a motor. However, these devices suffer from a number of problems such as, for example, the problem that metallic primary pans eventually become rusted and plug up outlets for draining water from the pan. Further, it is difficult for the pan to support the air condition system such as the motor and the pan cover, because of the additional weight caused by the metal pan, so that the motor cannot be used for a long time. It is also very difficult for the primary pans to separate from such devices because the structure is very complicated and device has a heavy weight. Furthermore, the air conditioning systems contain a pair of drain pipes passed therethrough.

In order to avoid such problems, U.S. Pat. No. 4,597,269, issued to the present inventor, discloses a plastic pan adapted to be mounted to the motor of an air conditioning system which includes a primary pan, a support bracket, height-adjustable brackets, and a motor mount bracket whereby the plastic pan avoids the plugging up of the outlet. However, this primary pan exhibits some problems with regard to convenient and reliable assembling and requires a lot of bolts for installation as well as such primary pan cannot apply a specific air conditioning system containing a pair of drain pipes passed therethrough.

U.S. Pat. No. 4,823,558, issued by the present inventor, discloses a plastic pan assembly for use in air conditioning systems and refrigerators wherein a plastic pan having a raised portion or a rail disposed on the outside surface of the bottom thereof is easily engaged with a channeled supporting bracket. However, this pan assembly cannot apply to a specific air conditioning system containing a pair of drain pipes passed therethrough.

The present inventor is also prosecuting another U.S. patent application Ser. No. 07/286,863, filed Dec. 20, 1988, now U.S. Pat. No. 4,862,704, which discloses an improved primary pan for use in an air conditioning system which includes a C-shaped plastic pan having a raised portion or a rail disposed on the outside surface of the bottom thereof, a channeled supporting bracket having a plurality of elongated apertures for engaging the raised portion of the rail of the plastic pan, and a pair of fan covers having a channel disposed on the outside surface of the top and a circumferential raised portion disposed around a lower outlet thereof for effectively mounting to and separating from the supporting bracket to the plastic pan with only two pairs of screws. However, this pan assembly cannot apply to a specific air conditioning system containing a pair of drain pipes passed therethrough.

The present inventor is also prosecuting still another U.S. patent application Ser. No. 07/381,261, filed July 18, 1989, now U.S. Pat. No. 4,916,919 which discloses an improved primary pan for use in an air conditioning system wherein a channeled supporting bracket is utilized to tightly engage and effectively support a plastic pan which includes a drain plastic pan and a plastic support plate which contains a C-shaped circumferential portion and a C-shaped extending portion thereof, the channeled supporting bracket having a plurality of elongated apertures being mounted on a motor and a fan cover, whereby the plastic primary pan assembly can be easily associated with and separate from the air conditioning system and easily adjusted to incline the plastic primary pan for drawing condensate water through an outlet disposed in the plastic primary pan. However, this primary pan cannot apply to a specific air conditioning system containing a pair of drain pipes passed therethrough.

SUMMARY OF THE INVENTION

Accordingly, it is an object of the present invention to provide an improved plastic pan assembly for use in air conditioning systems and refrigerators containing a pair of drain pipes therethrough.

Another object of the present invention is to provide a plastic primary pan which is structured for draining condensate water through an outlet while avoiding the plugging up of the outlet.

Still another object of the present invention is to provide an air conditioning system which includes an assembly for easily mounting a primary pan to a pair of supporting brackets which have a pair of elongated rails for being easily mounted to a motor and fan covers.

Yet another object of the present invention is to provide an improved plastic primary pan for utilizing to a specific air conditioning system having a pair of drain pipes passed therethrough.

A further object of the present invention is to provide a plastic primary pan including a base primary pan which contains a pair of blind plates having a pair of semi-cylinders, respectively, to be removed one of them from the base primary pan, a pair of rubber packings, and an assembly plate having a pair of semicylinders to be inserted into the base primary pan, after taking out one of the pair of blind plates from the base primary pan, assembling with a base primary pan instead of the blind plate so as to pass a pair of drain pipes therethrough, whereby the plastic primary pan can easily assemble the base primary pan with the assembly plate, the pair of rubber packings, and the pair of drain pipes.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a plastic primary pan assembly for use in conjunction with an air conditioning system, which includes a base primary pan containing a pair of blind plates having a pair of semi-cylinders, respectively, to be removed one of them from the base primary pan, a pair of rubber packings, and an assembly plate having a pair of semi-cylinders to be inserted into the base primary pan, after taking out one of the pair of blind plates from the base primary pan, assembling with a base primary pan instead of the blind plate so as to pass a pair of drain pipes therethrough, whereby the plastic primary pan can easily assemble the base primary pan with the assembly plate, the pair of rubber packings, and the pair of drain pipes.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
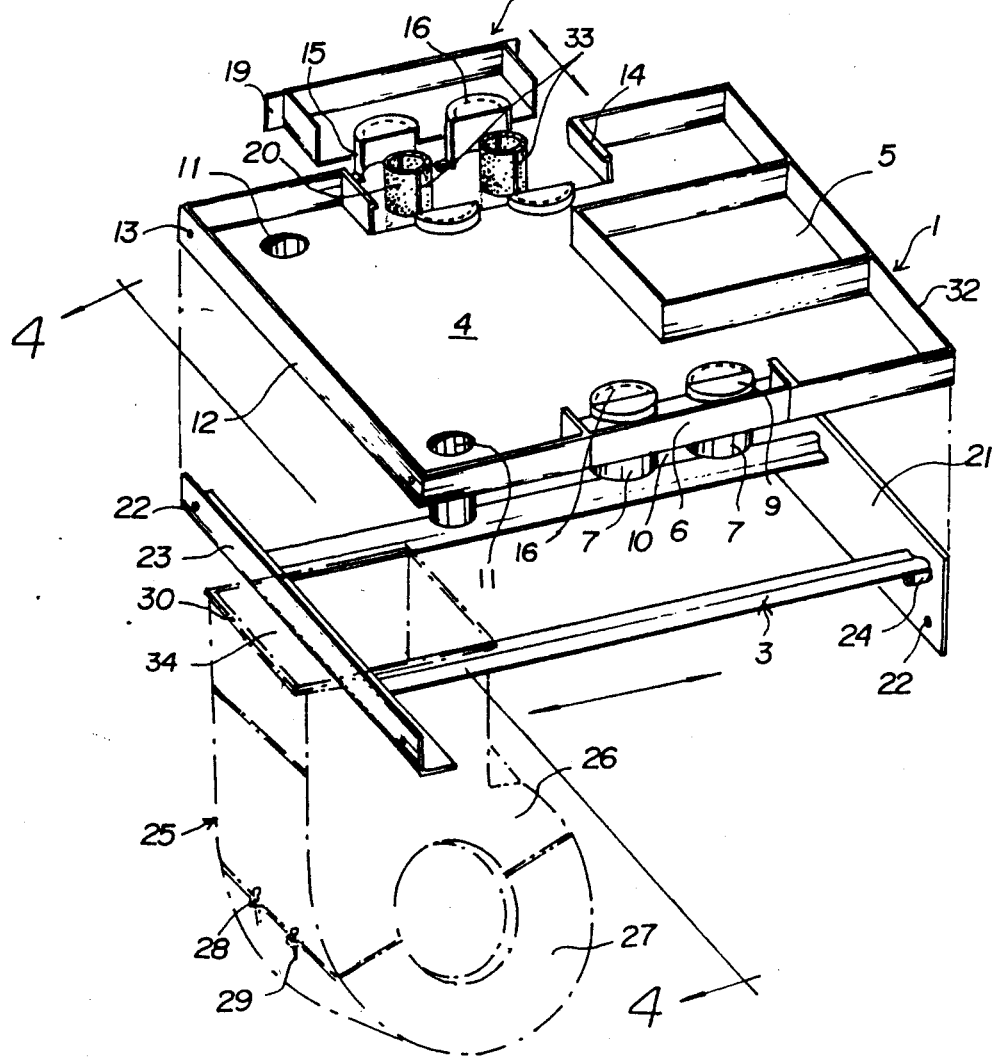
FIG. 1 is an exploded perspective view of showing basic components of a plastic primary assembly of the present invention.

Referring now in detail to the drawings for the purpose of illustrating preferred embodiments of the present invention, the plastic primary pan assembly as shown in FIG. 1 includes a plastic base primary pan 1, a plastic assembly plate 2, a pair of rubber packings 20, a pair of L-shaped, elongated supporting brackets 3 which are mounted to a fan cover 25, and a motor (not shown).

The plastic base primary pan 1 is provided with a plastic pan body 4, an pan cover aperture 5, a front wall 32, a rear wall 12, two side walls 6 having a pair of plastic blind plates 10 disposed at the opposite side thereof, and outlets 11 disposed in both end portions thereof for draining condensate water.

Figure 5:
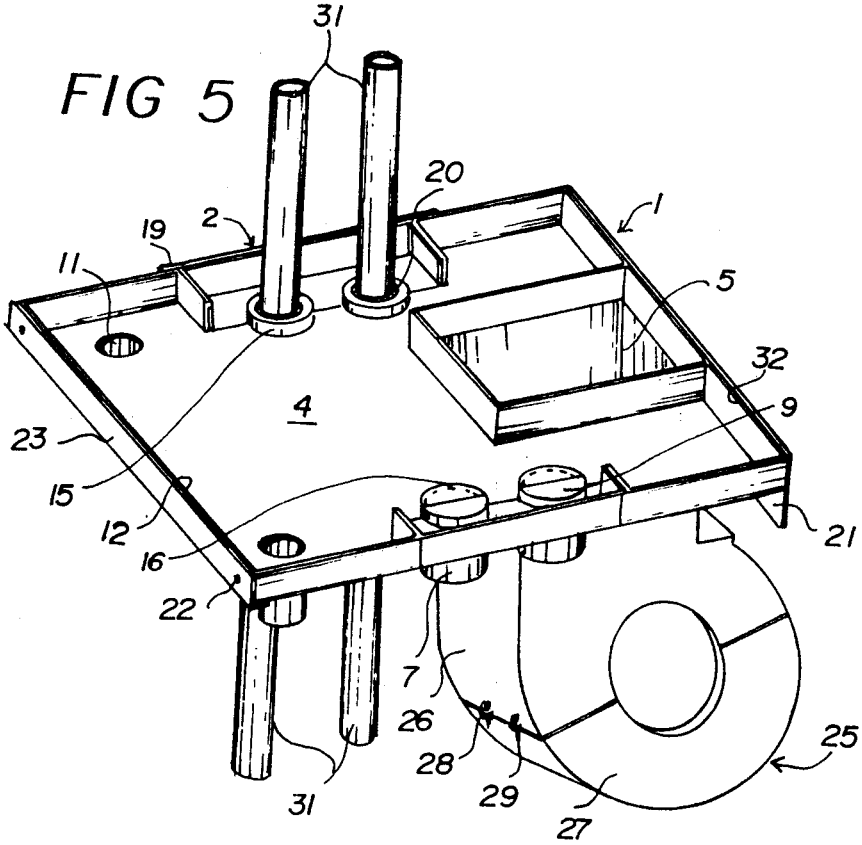
FIG. 5 is a perspective view of the assembled primary pan assembly containing a pair of drain pipes passed therethrough according to the present invention.

The plastic blind plate 10 contains a pair of semi-cylinders 7 having a semi-composite cap 9, respectively for mating with a pair of semi-cylinders 8 supported on the plastic pan body 4 and having a semi-removable cap 16. Thus the semi-cylinders 7 and 8 are supported on the pair of blind plates 10 and the pan body 4, respectively. Also, the pair of plastic blind plates 10 are oppositely located on the pan body 4 of the base primary pan 1 as a composite of the side walls 6 and can be easily taken out of the base primary pan by selecting one of the blind plates 10 depending on the position of a pair of built drain pipes 31 to a wall of a building (FIG. 5). For example, when the drain pipes 31 is located at the left side wall of the building, the left side blind plate 10 has to remove from the base primary pan 1.

The assembly plate 2 has a pair of semi-cylinders 15 having a removable cap 16 and a pair of extended front walls 19 for stopping the assembly plate 2 to overcome to the side wall 6 when the assembly plate 2 is assembled with the base primary pan 1.

Figure 2:
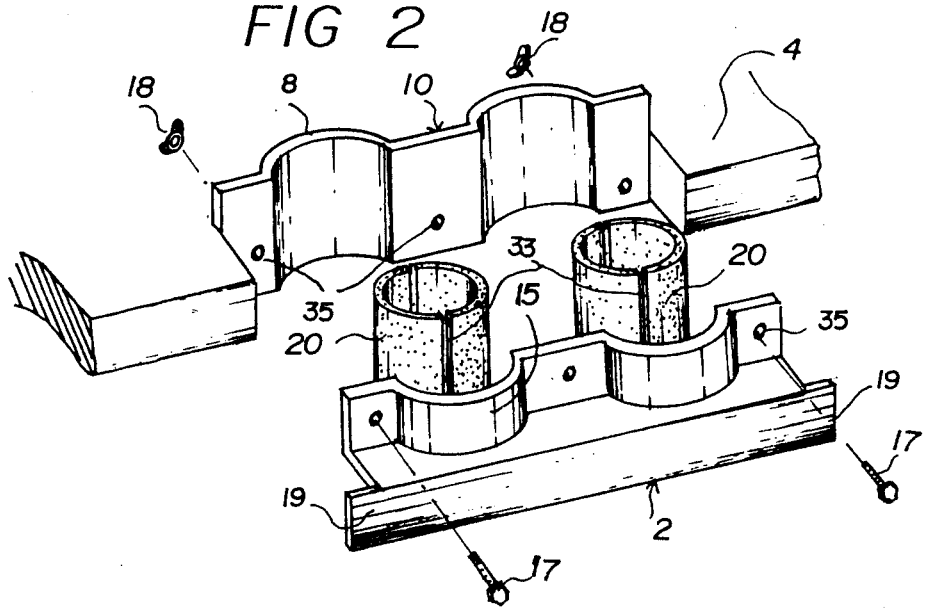
FIG. 2 is an exploded perspective view of showing a base plastic primary pan, an assembly plate, and a pair of rubber packings of the present invention in a turned over position.
Figure 3:
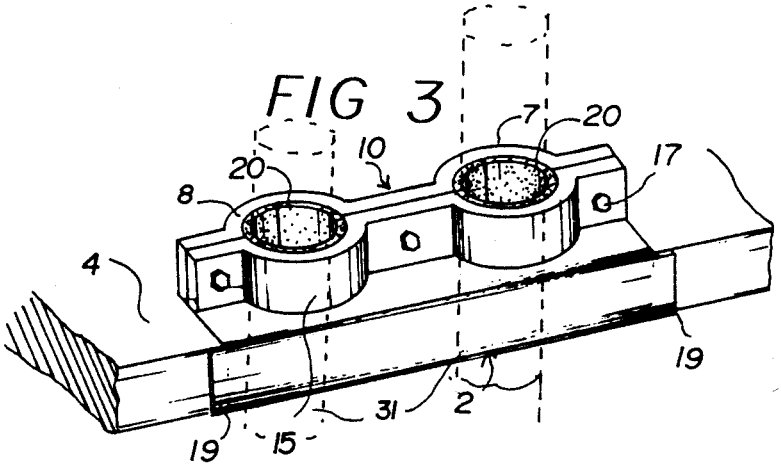
FIG. 3 is a perspective view of the plastic primary pan assembly with its associated pair of rubber packings and assembly plate of the present invention.

As shown in FIGS. 2 and 3, when the blind plate 10 is replaced with the assembly plate 2, first of all, the blind plate 10 is removed from the base primary pan 1; second, both pair of removable caps 16 of both pair of cylinders 7 and 15 are removed from the cylinders 7 and 15; third, the rubber packings 20 are wound around the built drain pipes 31 through a cutting line 33, respectively; and fourth, the assembly plate 2 is assembled with the blind plate 10 supported on the primary pan body 4 with the drain pipes having the rubber packing 33, respectively, by mounting both plates 2 and 10 with bolts 17 and nuts 18 through bolt apertures 35.

Figure 4:
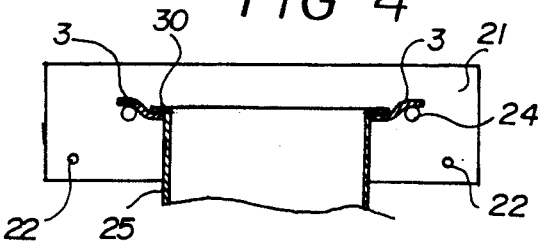
FIG. 4 is a sectional view of FIG. 1, taken along line 4-4.

As shown in FIGS. 1 and 4, the L-shaped, elongated supporting brackets 3 are provided with an engaging plate 21 for mounting it thereto at one end. The engaging plate 21 is attached to the wall of the housing of the air conditioning system with support pins 24 supported on the engaging plate 21. The L-shaped, elongated supporting brackets 3 are made of plastic, aluminum, steel, and the like. And the elongated brackets 3 are provided with a L-shaped, elongated support 23 for securing -to the L-shaped supporting brackets 3 at its bottom surface and the other end thereof. Therefore, when the fan cover 25 is inserted into the pair of channeled supporting brackets 3, its raised portion 30 is slidably engaged on the channeled supporting brackets 3 in the direction indicated by arrow as shown in FIGS. 1 and 4. The engaging plate 21 has a plurality of screw apertures 22 for inserting into the walls of a housing of the air conditioning system. Also, the engaging plate 21 supports to the front wall 32 of the base primary pan 1. The L-shaped, elongated support 23 has a plurality of screw pins 22 for receiving the rear wall 12 of the base primary pan 1 to combine them together by screws (not shown).

As shown in FIGS. 1 and 5, the fan cover 25 defined an upper fan cover 26 and a lower fan cover 27. The upper fan cover 25 includes the circumferential raised portion 30 disposed around the top portion of the lower outlet 34 thereof for easily mounting to and separating from the pair of L-shaped, elongated brackets 3. Also, the fan cover 25 has pin engagements 28 disposed on the upper and lower pan covers 26 and 27, respectively, for receiving pins 29 to combine them together. The motor is provided with a motor plate for being mounted to the channeled supporting bracket 3 (not shown).

In assembly, the engaging plate 21 is attached to the wall of the housing of the air conditioning system with the inclination for easily draining condensate water through one of the outlets 11. The pair of L-shaped, elongated brackets 3 are suspended to the pair of supports 24 disposed on the engaging plate 21 at one end thereof. The L-shaped, elongated support 23 is attached to the other end of the pair of L-shaped, elongated supporting brackets 3 at the outer surface of the bottom plate thereof for easily receiving the pan cover 25 through the channeled brackets 3. After the fan cover 25 containing a fan (not shown) is combined together with the pins 29 through the pin engagements 28, the elongated supporting bracket 3 is engaged with the combined fan cover 25 by the raised portion 30 of the upper fan cover 26. And the motor is mounted to the plastic channeled supporting brackets 3 (not shown). First of all, one blind plate 10 is taken out of the base primary pan 1 and the removable caps 16 of the pair of semi-cylinders 7 are taken out of the semi-cylinders 7.

On the other hand, the semi-removable caps 16 of the pair of semi-cylinders 15 of the assembly plate 2 are taken out of the semi-cylinders 15. Thereafter, after the pair of rubber packings 20 are put on the pair of built drain pipes 31 through the cut lines 33, respectively, the assembly plate 2 is inserted into a space formed by removing one of the blind plates 10, as containing the pair of drain pipes 31 having rubber packings 33, along a raised portions 14 of both sides of a wall connected to the side wall 6 in the direction indicated by arrow as shown in FIG. 1. At that time, the stopper 19 controls the assembly plate 2 to combine with the pair of the remaining semicylinders 7 supported on the pan body 4. Then, with the bolts 17 and nuts 18 through apertures 35 of the assembly plate 2 and remaining semi-cylinders 7, the plastic base primary pan 1 is tightly mounted to the remaining semi-cylinder 7 with the built drain pipes 31. Also, in turn, the assembled primary pan assembly is easily disassembled. At this time, the pan cover 25 can be inserted into the channeled supporting brackets 3. Thereafter, the lower fan cover 25 is assembled with the upper pan cover 24 by inserting pins 29 into the pin engagements 28 thereof.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A primary pan assembly adapted to be mounted to the motor of an air conditioning system which comprises:

a plastic base primary pan provided with an outlet disposed on at least one side thereof, a pair of plastic blind plates detachably combined with said plastic base primary pan and disposed at both sides of said plastic base primary pan, said plastic blind plates containing a pair of semi-cylinders for mating with a pair of semi-cylinders supported on said plastic base primary pan, said semi-cylinders supported on said plastic base primary pan having semi-removable caps, respectively;

an assembly plate having a pair of semi-cylinders for substituting for the detachable blind plate so as to mate with said pair of semi-cylinders supported on the plastic base primary pan, said semi-cylinders of said assembly plate having semi-removable caps, respectively, a pair of rubber packings for winding a pair of built drain pipes, a pair of L-shaped, elongated supporting brackets provided with a pair of supporting member mounted thereto at both end thereof for supporting said plastic base primary pan, a motor mounted to said channeled supporting brackets by screws, and a fan cover having a circumferential raised portion disposed around a lower outlet for suspending said fan cover on said elongated supporting brackets, whereby the plastic primary pan assembly can be mounted to housing walls of the air conditioning system at an inclination for easily draining the condensate water through the outlet and can be easily installed by removing removable caps of the semi-cylinders supported on the plastic base primary pan and the assembly plate, respectively, and forming a pair of cylinders so as to pass the conventional drain pipes therethrough and the plastic primary pan can be smoothly mounted to and separated from the elongated supporting brackets.

2. The primary pan assembly of claim 1, wherein the plastic primary pan defines a plastic base primary pan with a pair of the detachable plates, a fan hole for mating with said fan cover and a plurality of pan walls.

3. The primary pan assembly of claim 1, wherein the pair of assembly plates include a plurality of screw apertures for engaging pins with screw apertures of the semi-cylinders supported on the base primary pan so as to combine them together with screws or bolts and nuts.

4. The primary pan assembly of claim 1, wherein the rubber packings include a cut line for easily putting it into the built drain pipes.

5. The primary pan assembly of claim 1, wherein the pair of supporting brackets are made of aluminum.

6. The primary pan assembly of claim 1, wherein the pair of supporting brackets are made of steel.

7. The primary pan assembly of claim 1, wherein the pair of supporting brackets are made of plastic.

8. The primary pan assembly of claim 1, wherein the fan cover is assembled with an upper fan cover and a lower fan cover by inserting pins into pin engagements for easily inserting a fan thereinto.

9. The primary pan assembly of claim 1, wherein the pair of supporting members connected to said pair of supporting brackets define an engaging plate for attaching to a wall of a housing of the air conditioning system, an L-shaped, elongated support for combining with said plastic primary pan together.

10. The primary pan assembly of claim 9, wherein the pair of supporting member are provided with a plurality of pin apertures disposed thereon.

* * * * *